United States Patent [19]

Ruegsegger

[11] 4,405,914

[45] Sep. 20, 1983

[54] FUSIBLE LINKS

[76] Inventor: Donald R. Ruegsegger, 425 W. Maple, Waterloo, Ind. 46793

[21] Appl. No.: 303,203

[22] Filed: Sep. 18, 1981

[51] Int. Cl.[3] ..... H01H 85/04

[52] U.S. Cl. ..... 337/152; 337/232

[58] Field of Search ..... 337/148, 152, 201, 232, 337/238, 290, 292, 295

[56] References Cited

U.S. PATENT DOCUMENTS

| | | | |
|---|---|---|---|
| 2,493,601 | 1/1950 | Smith | 337/292 X |
| 3,253,104 | 5/1966 | Fister | 337/232 |
| 4,055,829 | 10/1977 | Ruegsegger | 337/416 |

*Primary Examiner*—George Harris

*Attorney, Agent, or Firm*—John A. Young; Larry J. Palguta

[57] ABSTRACT

A thermal fuse is comprised of a pair of internested, flat, thin metallic plates, each plate having peripheral upturned flanges along opposite edges of the plate. The flanges of the lower plate each have a notch formed therein and the upper plate has a tab extending transversely from each side through a respective notch. The notches each have a side inclined to the plate to form a ramp, the edge corners of the tabs being cammed up the ramp of the respective notches when the plates are pulled apart in a direction parallel to the plane of the plates, to lift the upper plate perpendicularly away from the lower plate so that the flat confronting surfaces of the plates are drawn apart.

6 Claims, 5 Drawing Figures

FUSIBLE LINKS

BACKGROUND OF THE INVENTION

1. Field of the Invention

This invention is in the field of fusible links, of the break-away type that have a pair of metallic plates, soldered together and are then placed in a strategic location to monitor the existence of any fires and may form a part of fire prevention equipment, such as smoke detectors or safety devices. The soldered plates are placed under spring tension and when the ambient temperature heats the plates above the eutectic point of the solder, the plates separate.

2. Brief Description of the Prior Art

A recent advance in the art is disclosed in U.S. Pat. No. 4,055,829, issued to the applicant herein. That patent is directed to the problem encountered in the art of links tending to rejoin after the initial separation if there is a failure of the links to fully separate. While the device in that patent is an improvement over prior devices and is satisfactory in many respects, full and complete separation is not insured to the extent that this invention provides. Important to the correct operation of a fuse is that it respond accurately to a critical temperature. Separation of the fuse link components must be clean and abrupt. Shortcomings of previous fuses is the time delay, incomplete separation and lack of consistent response to a critical temperature. The present invention does so respond accurately and "cleanly", i.e., the separation of plates is abrupt upon reaching the critical temperature.

SUMMARY OF THE INVENTION

A pair of flat, thin overlapping, metallic plates each include peripheral upwardly extending elongated flanges along opposite plate edges. The plates each have ends that are adapted for attachment to spring members so that tension force exerted on the plates in the plane of the plates tends to pull them apart. Confronting flat surfaces of the plates are soldered together and are used with conventional fire control devices such that a rise in ambient temperature can cause heating of the plates above the eutectic point of the solder, whereupon the spring forces separate the plates and operate an alarm or other apparatus.

Each of the flanges on the lower plate has a notch. Each notch has a side that is inclined 45 degrees to a flat surface of the plate to form a ramp edge. The upper plate has a tab transversely extending from each flange side that engages a respective notch. Upon heat in excess of a critical amount, the solder melts at its eutectic temperature and spring force causes relative sliding between the plates resulting in an edge corner of each of the tabs being cammed upwardly on its respective ramp edge, causing the upper plate to move upwardly and away from the lower plate. Since there is only an edge corner contact with the ramp between the upper and lower plates, sudden and complete separation occurs between the plates because the plates can more easily move relative one another. Cooling of the solder while the corners are on the ramp edges will not rejoin the plates. The spring force is sufficient to pull apart the plates, even if solder should cool quickly to form a joint. The sole point of direct engagement between the plates is through the ramp edges and tabs, and any inadvertent solder joint formation, occurring after melting between these surfaces is highly unlikely. Even if such inadvertent rejoining did occur any such joint would be relatively weak and overcome by the spring forces pulling the plates apart.

In fusible links, separation of the links is insured upon a rise in ambient temperature to a critical temperature. It is necessary that this be achieved in a link where cost is small to make their use economically feasible It is an object of this invention to provide a low cost fusible link that is insured of complete separation when the eutectic point of the retaining solder is reached.

Another object of the invention is to provide in a soldered link of the previous object, a sliding corner contact on a ramp edge to separate the links when the fusion point of the solder is reached.

These and other objects will become more apparent from a description of the preferred embodiment in reference to the drawings.

DESCRIPTION OF A PREFERRED EMBODIMENT

Figure 1:
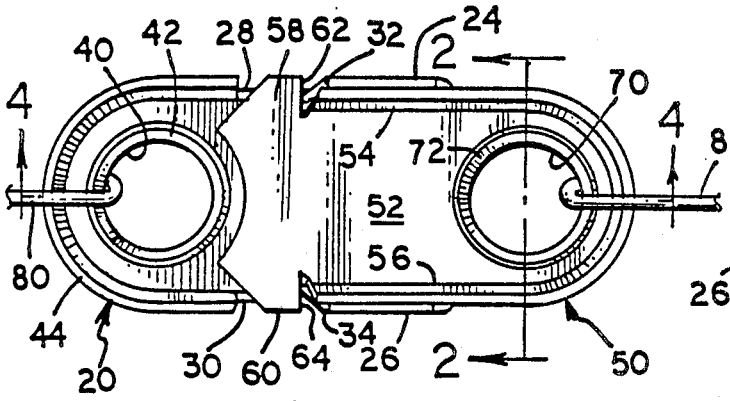
FIG. 1 is a top plan view of an embodiment of this invention showing the links and internested position.
Figure 2:
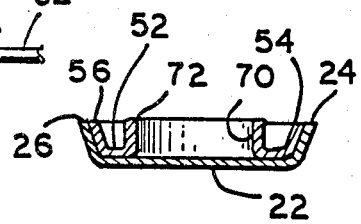
FIG. 2 is a section view taken on Lines 2--2 of FIG. 1.

Referring to the drawing, link 20 comprises a flat, thin plate 22 having elongated flanges 24,26 formed upwardly and outwardly from opposite edges thereof. Notches 28,30 are formed respectively in flanges 24,26. Notches 28,30 have upwardly inclined ramp edges 32,34 respectively, each of which forms an angle of 45 degrees with plate 22. Adjacent the end 36 of plate 22, is a circular opening 40 surrounded by upstanding circular flange 42. At end 36 and continuing along the plate is an upwardly and outwardly formed semicircular flange 44. Flanges 42,44 strengthen plate 22 and provide protection edges. The other end 46 (FIG. 3) of plate 22 is concave.

Figure 5:
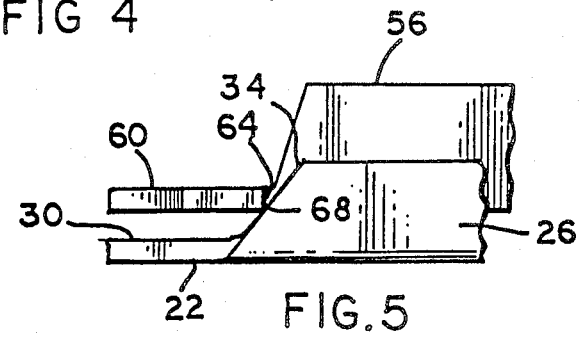
FIG. 5 is a partial, enlarged side elevational view of the embodiment of FIG. 1 with the links partially separated.

The other link 50 consists of a flat thin plate 52 with peripheral flanges 54,56 formed upwardly and outwardly from opposite edges thereof. The width of plate 52 is smaller than the width of plate 22 to enable it to be slidably internested therewith, as shown in FIG. 1. Tabs 58,60 are formed integrally with plate 52 and are coplaner with plate 52. Tabs 58,60 have edges 62,64 respectively. The lower corners of edges 62,64 are disposed to ride upwardly on ramp edges 32,34 respectively, when links 20,50 are pulled apart (FIGS. 1,5). Corner 68 of tab 60 is shown on ramp edge 34 in FIG. 5. Likewise a corner 66 of edge 62 rides against ramp edge 32. As a result the two plates are cammed apart when they are pulled in opposite directions. Opening 70 in plate 52 has a surrounding upstanding flange 72 and is adjacent rounded end 74, of plate 52, around which flanges 54,56 extend, and join one another. The end 76 of plate 52 is concave the same as end 46 of plate 22.

Figure 3:
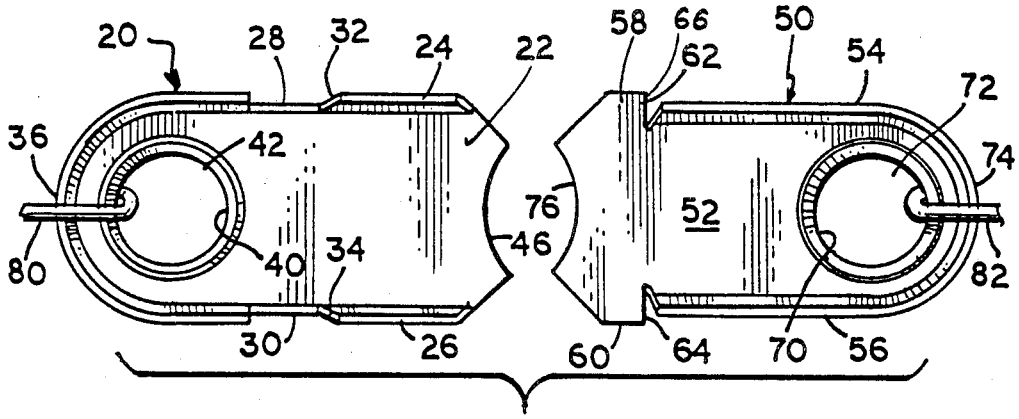
FIG. 3 is a top plan view of the embodiment of FIG. 1 showing the links separated.
Figure 4:
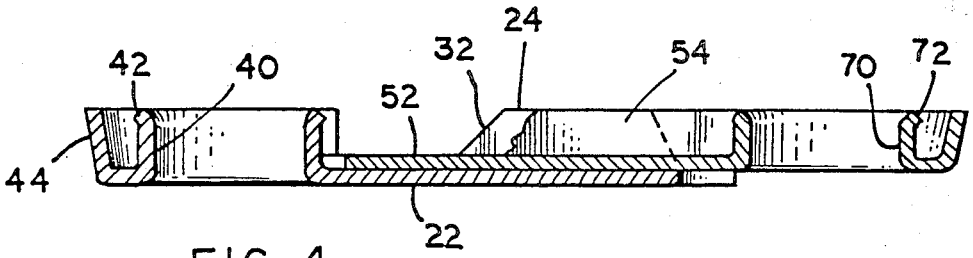
FIG. 4 is a section view taken on Line 4—4 of FIG. 1.

In operation links 20,50 are joined in the position of FIG. 1 by fluxing and soldering in a manner well known in the art, the confronting surfaces of plates 22,52 being thus joined together. Springs 80,82 are next placed in openings 40,70 respectively (FIG. 3). Upon a rise in ambient temperature if the links 20,50 are heated to a temperature above the ambient temperature of the solder, the solder will melt, and then springs 80,82 will pull the links 20,50 apart. The separation occurs when corners 66,68 are cammed upwardly on ramp edges 32,34 respectively, lifting plate 52 upwardly away from plate 22, breaking the contact therebetween. The minimum contact between links 20,50 at the corners 66,68 and edges 32,34 enables the links to readily and completely separate.

A feature of this invention is that even if the solder cools below the fusion point after separation of the plates there is virtually no possibility of the links recontacting and becoming resoldered, rejoined, or refused in the original condition.

Although the invention has been described and claimed in connection with certain selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

What is claimed is:

1. A break-away fuse comprising a pair of flat, thin metallic plates;

each plate including an upwardly extending elongated flange along opposite edges thereof;

said plates being in overlapping relation to one another, one end of one plate extending in one direction from the overlapped plates and one end of the other plate extending in the opposite direction; the lower section of the upper plate confronting the upper surface of the lower plate, said confronting surfaces adapted to be soldered together;

said flanges of said lower plate each having a notch formed therein;

said notches each having an edge inclined to the lower plate and forming a ramp edge, the inclinations of said ramp edges being substantially equal;

said upper plate having a tab extending transversely from each flange thereof, said tabs alignable with and insertable in a respective notch;

an edge corner of each tab being engageable with and slidable up the ramp edge of the respective notch when said ends are longitudinally pulled apart to lift said upper plate away from said lower plate.

2. The apparatus of claim 1 wherein the notch edges are inclined at an angle of approximately 45 degrees to the lower plate.

3. The apparatus of claim 1 wherein said tabs are integral with said upper plate.

4. The apparatus of claim 1 wherein said notches are transversely opposite one another.

5. The apparatus of claim 1 including flanges upstanding from said upper and lower plates at each of said ends.

6. The apparatus of claim 1 wherein said flanges are inclined outwardly from their respective plate surfaces.

* * * * *